US006482777B2

(12) United States Patent
Cain

(10) Patent No.: US 6,482,777 B2
(45) **Date of Patent: *Nov. 19, 2002**

(54) LUBRICATING COMPOSITIONS WITH IMPROVED THERMAL STABILITY AND LIMITED SLIP PERFORMANCE

(75) Inventor: Robert W. Cain, Lyndhurst, OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/420,474

(22) Filed: Oct. 19, 1999

(65) Prior Publication Data

US 2002/0086802 A1 Jul. 4, 2002

Related U.S. Application Data

(60) Provisional application No. 60/104,807, filed on Oct. 19, 1998.

(51) Int. Cl.[7] ..... C10M 137/02; C10M 141/10

(52) U.S. Cl. ..... 508/185; 508/192; 508/269; 508/371; 508/375; 508/435; 508/436; 508/438

(58) Field of Search ..... 508/185, 192, 508/269, 371, 375, 435, 436, 438

(56) References Cited

U.S. PATENT DOCUMENTS

| | | | | | |
|---|---|---|---|---|---|
| 3,903,001 | A | * | 9/1975 | Gates et al. | 508/371 |
| 4,180,466 | A | * | 12/1979 | Newingham et al. | 508/188 |
| 4,634,543 | A | | 1/1987 | Okada et al. | 252/78.5 |
| 5,078,893 | A | | 1/1992 | Ryer et al. | 252/49.6 |
| 5,126,064 | A | * | 6/1992 | Barber et al. | 508/188 |
| 5,225,093 | A | * | 7/1993 | Campbell et al. | 508/188 |
| 5,547,596 | A | * | 8/1996 | Omiya | 508/188 |
| 5,767,044 | A | * | 6/1998 | Bigelow et al. | 508/186 |
| 5,942,470 | A | * | 8/1999 | Norman et al. | 508/189 |

OTHER PUBLICATIONS

PCT/US99/24365; PCT International Search Report mailed Jan. 21, 2000.

* cited by examiner

*Primary Examiner*—Jacqueline V. Howard
(74) *Attorney, Agent, or Firm*—William C. Tritt; Teresan W. Gilbert; Michael F. Esposito

(57) ABSTRACT

This invention relates to a lubricating composition comprising a blend of a major amount of an oil of lubricating viscosity, gear or transmission oil package and a top treatment which comprises at least one saturated fatty phosphate ester or salt, wherein the lubricating composition is free of saturated fatty phosphites. Tin another embodiment, the invention relates to a lubricating composition comprising a major amount of an oil of lubricating viscosity, at least one saturated fatty phosphate ester or salt, at least one polysulfide and at least one phosphorus antiwear or extreme pressure agent, wherein the lubricating composition is free of saturated fatty phosphites. The invention relates to additive combinations which when added to a lubricant can provide and improve frictional and, optionally, thermal stability properties. The additives include a phosphate ester or salt wherein the hydrocarbyl group of the phosphate is a fatty-saturated group. The top treatment may also include a substituted fatty imidazoline or reaction product of a fatty carboxylic acid and polyalkylene polyamine and/or a borated dispersant.

25 Claims, No Drawings

LUBRICATING COMPOSITIONS WITH IMPROVED THERMAL STABILITY AND LIMITED SLIP PERFORMANCE

CROSS REFERENCE TO PROVISIONAL APPLICATION

This application claims priority from provisional application Ser. No. 60/104,807, filed Oct. 19, 1998, the entire disclosure of which is hereby incorporated by reference.

TECHNICAL FIELD OF THE INVENTION

This invention relates to lubricating compositions which contain a combination of additives which provide improved friction, and thermal stability properties to lubricating compositions. The lubricating compositions contain the combination of (A) a fatty saturated phosphate, and optionally (B) at least one alkyl imidazoline or a reaction product of a carboxylic acid and a polyamine, and/or (C) a borated dispersant overbased composition.

BACKGROUND OF THE INVENTION

Although conventional differentials generally perform satisfactory under normal conditions, they suffer from a drawback called stalling. Stalling is the phenomenon which occurs when one wheel loses traction and the vehicle does not move. The reason for this is related to the design of the differential, where all of the driving torque is taken away by the wheel with less traction. Limited-slip differential designs overcome stalling by the use of clutch plates or friction cones. These devices help transfer more power to the wheel with traction. The result is that both wheels spin and the automobile moves. The common problem with these devices is the noise or chatter resulting from stick-slip (engagement-disengagement) phenomenon that occurs between the elements of clutches at low speeds. Additives, called friction modifiers, are used to impart proper frictional characteristics to the lubricant to overcome this problem.

As a general rule, friction modifiers hurt the performance of antiwear and/or extreme pressure additives. Generally, the antiwear or extreme pressure additives in lubricants reduce damage by maintaining a layer of lubricant between the moving parts of the equipment. The additives of the lubricant which provide antiwear or extreme pressure help reduce harmful metal on metal contact. There is a need for lubricants for limited slip axles which provide a balance between frictional properties and antiwear/extreme pressure properties.

Thermal stability of the lubricant is another important parameter. Traditional lubricants are unable to endure high operating temperatures of today's equipment and tend to decompose in the bulk and are not available when and where needed. There is a need for those lubricants to be thermally stable. One measure of thermal stability is the ASTM L-60 test. The antiwear extreme pressure protection is generally reflected in the ASTM L-42 and ASTM L-37 tests.

"Top treatments" are a combination of additives which are added on top of existing lubricants to improve certain properties. It is desirable to have a top treatment that may be added to a API GL-4 or GL-5 and MIL-PRF-2105E lubricant packages to provide friction and optionally thermal stability.

SUMMARY OF THE INVENTION

This invention relates to a lubricating composition comprising a blend of a major amount of an oil of lubricating viscosity, gear or transmission oil package and a top treatment which comprises at least one saturated fatty phosphate ester or salt, wherein the lubricating composition is free of saturated fatty phosphites. Tin another embodiment, the invention relates to a lubricating composition comprising a major amount of an oil of lubricating viscosity, at least one saturated fatty phosphate ester or salt, at least one polysulfide and at least one phosphorus antiwear or extreme pressure agent, wherein the lubricating composition is free of saturated fatty phosphites. The invention relates to additive combinations which when added to a lubricant can provide and improve frictional and, optionally, thermal stability properties. The additives include a phosphate ester or salt wherein the hydrocarbyl group of the phosphate is a fatty-saturated group. The top treatment may also include a substituted fatty imidazoline or reaction product of a fatty carboxylic acid and polyalkylene polyamine and/or a borated dispersant.

DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents which do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g., pyridyl, furyl, thienyl, imidazolyl, etc.

In general, no more than about 2, preferably no more than one, hetero substituent will be present for every ten carbon atoms in the hydrocarbyl group. Typically, there will be no such heteroatom substituents in the hydrocarbyl group. Therefore, the hydrocarbyl group is purely hydrocarbon.

As described above, the above additives include top treatments for existing lubricating compositions. In another embodiment, the additives are used in lubricating compositions described herein. Specifically, these top treatments provide improved friction and, optionally, thermal stability properties to gear or transmission lubricants. The gear lubricants typically include API GL-4 and GL-5 formulations and API GL-5 API MT-1 formulations.

Fatty Phosphates

As described above, the lubricant additive may be a phosphate ester or salt. The phosphate ester or salt is present at a level to provide from about 0.25% to about 4%, or from about 0.5% to about 2%, or from about 0.75% to about 1.5% phosphate ester or salt to the lubricant. Here and elsewhere in the specification and claims, the range and ratio limits may be combined. The top treatment typically contains a major amount of the phosphate ester or salt. More specifically, the phosphate ester or salt is present in an amount from about 55% to about 100%, or from about 65% to about 95%, or from about 75% to about 90% by weight of the additives of the top treatment.

The phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography)); and Alfol22+ alcohols ($C_{18}$–$C_{28}$ primary alcohols containing primarily $C_{22}$ alcohols). Alfol alcohols are available from Continental Oil Company. Another example of a commercially available alcohol mixture is Adol 60 (about 75% by weight of a straight chain $C_{22}$ primary alcohol, about 15% of a $C_{20}$ primary alcohol and about 8% of $C_{18}$ and $C_{24}$ alcohols). The Adol alcohols are marketed by Ashland Chemical.

A variety of mixtures of monohydric fatty alcohols derived from naturally occurring triglycerides and ranging in chain length from $C_8$ to $C_{18}$ are available from Procter & Gamble Company. These mixtures contain various amounts of fatty alcohols containing 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols.

In one embodiment, the phosphate contains from about 14 to about 18 carbon atoms in each hydrocarbyl group. The hydrocarbyl groups of the phosphate are generally derived from a mixture of fatty alcohols having from about 14 up to about 18 carbon atoms.

The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435 at Col. 21, line 4 to Col. 27, line 50, these passages being incorporated herein by reference.

The monoamines generally contain a hydrocarbyl group which contains from 1 to about 30 carbon atoms, or from 1 to about 12, or from 1 to about 6. Examples of primary monoamines useful in the present invention include methylamine, ethylamine, propylamine, butylamine, cyclopentylamine, cyclohexylamine, octylamine, dodecylamine, allylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

In one embodiment, the amine is a fatty ($C_{8-30}$) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

Other useful amines include primary ether amines, such as those represented by the formula, $R''(OR')_xNH_2$, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines represented by the formula $R_5$—$C(R_6)_2$—$NH_2$, wherein $R_5$ is a hydrocarbyl group containing from one to about 27 carbon atoms and $R_6$ is a hydrocarbyl group containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of tertiary aliphatic amines may also be used in preparing the phosphate salt. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. Pat. No. 2,945,749, which is hereby incorporated by reference for its teaching in this regard.

In another embodiment, the amine is a secondary amine. Specific of secondary amines include dimethylamine, diethylamine, dipropylamine, dibutylamine, diamylamine, dihexylamine, diheptylamine, methylethylamine, ethylbutylamine, ethylamylamine and the like. In one embodiment, the secondary amine may be a cyclic amine, such as piperidine, piperazine, morpholine, etc.

In one embodiment, the amine may be a hydroxyamine. Typically, the hydroxyamines are primary, secondary or tertiary alkanol amines or mixtures thereof. Such amines can be represented by the formulae: $H_2N—R'—OH$, $HR'_1—N—R'—OH$, and $(R'_1)_2—N—OH$, wherein each $R'_1$ is independently a hydrocarbyl group of one to about eight carbon atoms or hydroxyhydrocarbyl group having from two to about eight carbon atoms, preferably from one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyamines can also be an ether N-(hydroxyhydrocarbyl)amine. These are hydroxypoly (hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with aforedescribed amines and can be represented by the formulae: $H_2N—(R'O)_x—H$, $HR'_1—N—(R'—O)_x—H$, and $(R'_1)_2—N—(R'O)_x—H$, wherein x is a number from about 2 to about 15 and $R_1$ and R' are as described above. $R'_1$ may also be a hydroxypoly(hydrocarbyloxy) group.

In another embodiment, the amine is a hydroxyhydrocarbyl amine which contains at least one NH group. Useful hydroxyhydrocarbyl amine may be represented by the formula

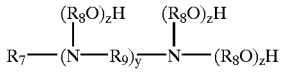

wherein $R_7$ is a hydrocarbyl group generally containing from about 6 to about 30 carbon atoms; $R_8$ is an alkylene group having from about two to about twelve carbon atoms, preferably an ethylene or propylene group; $R_9$ is an alkylene group containing up to about 5 carbon atoms; y is zero or one; and each z is independently a number from zero to about 10, with the proviso that at least one z is zero.

Useful hydroxyhydrocarbyl amines where y in the above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethyl, hexylamine.

In one embodiment, the amine may be a hydroxyhydrocarbyl amine, where referring to the above formula, y equals zero. These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleyl amine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

Alkylene polyamines are represented by the formula $HR_{10}N\text{-(Alkylene-N)}_n\text{-}(R_{10})_2$, wherein n has an average value from 1 to about 10, or from about 2 to about 7, or from about 2 to about 5, and the "Alkylene" group has from 1 to about 10 carbon atoms, or from about 2 to about 6, or from about 2 to about 4. In one embodiment, each $R_{10}$ is independently hydrogen; or an aliphatic or hydroxy-substituted aliphatic group of up to about 30 carbon atoms. In another embodiment, $R_{10}$ is defined the same as $R'_1$ above.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl) amine, propylenediamine, trimethylenediamine, tripropylenetetramine, tetraethylenepentamine, hexaethyleneheptamine, pentaethylenehexamine, etc.

Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylenepentaamine and 76.61% pentaethylenehexamine and higher (by weight). These alkylenepolyamine bottoms include cyclic condensation products such as piperazine and higher analogs of diethylenetriamine, triethylenetetramine and the like.

These alkylenepolyamine bottoms can be reacted solely with the acylating agent or they can be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO86/05501 which is incorporated by reference for its disclosure to the condensates and methods of making. The preparation of such polyamine condensates may occur as follows: A 4-necked 3-liter round-bottomed flask equipped with glass stirrer, thermowell, subsurface $N_2$ inlet, Dean-Stark trap, and Friedrich condenser is charged with: 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and 727 grams of 40% aqueous tris(hydroxymethyl)aminomethane (THAM). This mixture is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230–235° C. for 5 hours, then heated to 240° C. over 0.75 hour, and then held at 240–245° C. for 5 hours. The product is cooled to 150° C. and filtered with a diatomaceous earth filter aid. Yield: 84% (1221 grams).

In one embodiment, the polyamines are polyoxyalkylene polyamines, e.g., polyoxyalkylene diamines and polyoxyalkylene triamines, having average molecular weights ranging from about 200 to about 4000 and or from about 400 to about 2000. The preferred polyoxyalkylene polyamines include the polyoxyethylene and polyoxypropylene diamines and the polyoxypropylene triamines. The polyoxyalkylene polyamines are commercially available an may be obtained, for example, from the Jefferson Chemical Company, Inc. under the trade name "Jeffamines D-230, D-400, D-1000, D-2000, T-403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N(diethanol)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl)ethylenediamine, N,N'-bis(2-hydroxyethyl)-ethylene-diamine, 1-(2-hydroxyethyl) piperazine, mono(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above described polyamines are also useful.

In another embodiment, the amine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Fatty Imidazoline or Fatty Acid-polyamine Reaction Product

The top treatment and lubricating compositions also may include a fatty imidazoline or a reaction product of a fatty carboxylic acid and at least one polyamine. In one embodiment, the fatty imidazoline or a reaction product of a fatty carboxylic acid of and at least one polyamine is present in an amount to provide from about 0.01% to about 0.7%, or from about 0.05% to about 0.5%, or from about 0.1% to about 0.3% by weight to the final lubricant. In one embodiment, the fatty imidazoline or a reaction product of a fatty carboxylic acid of and at least one polyamine is present in the top treatment in an amount from about 1% to about 20%, or from about 3% to about 15%, or from about 5% to about 10% by weight of the top treatment additives.

The fatty imidazoline has fatty substituents containing from 8 to about 30, or from about 12 to about 24 carbon atoms. The substituent may be saturated or unsaturated, preferably saturated. In one aspect, the fatty imidazoline may be prepared by reacting a fatty carboxylic acid with a polyalkylenepolyamine, such as those discussed above.

The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid.

The fatty carboxylic acid is reacted with at least one polyamine. The polyamines may be aliphatic, cycloaliphatic, heterocyclic or aromatic. Examples of the polyamines include alkylene polyamines and heterocyclic polyamines. Specific examples are described above.

A preferred reaction product of a carboxylic acid and polyamine is made by reacting the above-described alkylene polyamines with a mixture of fatty acids having from 5 to about 30 mol percent straight chain acid and about 70 to 95% mol branch chain fatty acids. Among the commercially available mixtures are those known widely in the trade as isostearic acid. These mixtures are produced as a by-product from the dimerization of unsaturated fatty acids as described in U.S. Pat. Nos. 2,812,342; and 3,260,671. These patents are hereby incorporated by reference for their disclosure of these reaction products and methods of making the same.

The branched chain fatty acids can also include those in which the branch is not alkyl in nature, such as found in phenyl and cyclohexyl stearic acid and the chloro-stearic acids. Branched chain fatty carboxylic acid/alkylene polyamine products have been described extensively in the art. See, for example, U.S. Pat. Nos. 3,110,673; 3,251,853; 3,326,801; 3,337,459; 3,405,064; 3,429,674; 3,468,639; and 3,857,791. These patents are hereby incorporated by reference for their disclosures of fatty acid/polyamine condensates for their use in lubricating oil formulations.

In another embodiment, the reaction product of a fatty carboxylic acid and a polyamine are further reacted with an epoxide. Epoxides are generally lower aliphatic epoxides, having from 1 to about 7 carbon atoms, preferably from 1 to about 5 carbon atoms, preferably 2 to about 4 carbon atoms. Examples of these epoxides include ethylene oxide, propylene oxide, butylene oxide, cyclohexene oxide and octylene oxide. The epoxides generally react in an amount from about 0.5% to about 5% by weight of lower epoxide based on the total weight of the reaction product. The reaction generally occurs at a temperature above about 100° C. The reaction product of a fatty acid, polyamine and epoxide is described in U.S. Pat. No. 3,240,575 which is hereby incorporated by reference for its teachings to carboxylic acids, polyamines, epoxides and reaction products and methods of making the reaction products.

The following examples illustrate the reaction product of a fatty carboxylic acid of and at least one polyamine of the present invention.

EXAMPLE I-1

To 1133 parts of commercial diethylenetriamine heated at 110–150° C. is slowly added 6820 parts of isostearic acid over a period of two hours. The mixture is held at 150° C. for one hour and then heated to 180° C. over an additional hour. Finally, the mixture is heated to 205° C. over 0.5 hour; through this heating, the mixture is blown with nitrogen to remove volatiles. The mixture is held at 205–230° C. for a total of 11.5 hours and then stripped at 230° C./20 torr to provide the desired acylated polyamine as a residue containing 6.2% nitrogen.

EXAMPLE I-2

To 205 parts of commercial tetraethylenepentamine heated to about 75° C. there is added 1000 parts of isostearic acid while purging with nitrogen, and the temperature of the mixture is maintained at about 75°–110° C. The mixture then is heated to 220° C. and held at this temperature until the acid number of the mixture is less than 10. After cooling to about 150° C., the mixture is filtered, and the filtrate is the desired acylated polyamine having a nitrogen content of about 5.9%.

EXAMPLE I-3

A mixture (565 parts by weight) of an alkylene amine mixture consisting of triethylenetetramine and diethylenetriamine in weight ratio of 3:1 is added at 20°–80° C. to a mixture of equivalent amounts of a naphthenic acid having an acid number of 180 (1270 parts) and oleic acid (1110 parts; the total quantity of the two acids used is such as to provide one equivalent for each two equivalents of the amine mixture used). The reaction is exothermic. The mixture is blown with nitrogen while it is being heated to 240° C. in 4.5 hours and thereafter heated at this temperature for 2 hours. Water is collected as the distillate. To the above residue ethylene oxide (140 parts) is added at 170°–180° C. within a period of 2 hours while nitrogen is bubbled through the reaction mixture. The reaction mixture is then blown with nitrogen for 15 minutes and diluted with 940 parts of xylene to a solution containing 25% of xylene. The resulting solution has a nitrogen content of 5.4% and a base number of 82 at pH of 4, the latter being indicative of free amino groups.

Borated Compound

It has also been discovered that the inclusion of a boron compound with the above additives provides improved thermal stability to the formulation. The borated dispersant may be any boron compound which acts to provide and improve thermal stability to the formulation. Typically, the boron compound is a borated dispersant. The compound may also include borated fatty expoxides and alcohols as well as borated fatty carboxylic polyol. Generally, the borated compound is present in an amount from about 0.1% to about 3%, or from about 0.2% to about 2%, or from about 0.3% to about 1% by weight of the lubricating composition. The borated compound is present in the top treatment in an amount from about 5% to about 50% or from about 8% to about 40% or from about 10% to about 35% of the top treatment additive.

In one embodiment, the boron compound is a borated dispersant. The borated compound may be prepared by reacting a dispersant with one or more of the above described boron compounds. The dispersants are selected from the group consisting of: (a) acylated nitrogen dispersants, (b) hydrocarbyl substituted amines, (c) carboxylic ester dispersants, (d) Mannich dispersants, and (e) mixtures thereof.

The acylated nitrogen dispersant include reaction products of one or more carboxylic acylating agents such as the hydrocarbyl substituted carboxylic acylating agents and an amine. In one embodiment, the hydrocarbyl groups are derived from one or more of polyalkenes. The polyalkene includes homopolymers and interpolymers of polymerizable olefins or a polyolefinic monomer, preferably diolefinic monomer, such 1,3-butadiene and isoprene. The olefins have,in one embodiment, from 2 to about 30 carbon atoms, or from 2 to about 18, or from 2 to about 8, or to about 4. The olefins include alpha-olefins. Examples of olefins include ethylene, propylene, 1-butene, isobutene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc.

Generally, the olefin compound contains from about 2 to 5 carbon atoms and examples include ethylene, propylene, butylene, isobutylene, and amylene. Isobutene, propylene and their dimers, trimers and tetramers, and mixtures thereof are especially preferred olefinic compounds. Of these compounds, isobutylene and diisobutylene are particularly preferred. In one embodiment, the interpolymer is a homopolymer. An example of a preferred homopolymer is a polybutene, or a polybutene in which about 50% of the polymer is derived from isobutylene. The polyalkenes are prepared by conventional procedures.

The polyalkene is generally, characterized as containing from at least about 8 carbon atoms up to about 300, or from about 30 up to about 200, or from about 35 up to about 100 carbon atoms. In one embodiment, the polyalkene is characterized by an $\overline{M}n$ (number average molecular weight) greater than about 400, or greater than about 500. Generally, the polyalkene is characterized by an $\overline{M}n$ from about 500 up to about 5000, or from about 700 up to about 2500, or from about 800 up to about 2000, or from about 900 up to about 1500. In another embodiment, the polyalkene has a $\overline{M}n$ up to about 1300, or up to about 1200.

Number average molecular weight, as well as weight average molecular weight and the entire molecular weight distribution of the polymers, are provided by Gel permeation chromatography (GPC). For purpose of this invention a series of fractionated polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In another embodiment, the polyalkenes have a $\overline{M}n$ from about 1300 up to about 5000, or from about 1500 up to about 4500, or from about 1700 up to about 3000. The polyalkenes also generally have a $\overline{M}w/\overline{M}n$ from about 1.5 to about 4, or from about 1.8 to about 3.6, or from about 2.5 to about 3.2. The hydrocarbyl substituted carboxylic acylating agents are described in U.S. Pat. No. 4,234,435, the disclosure of which is hereby incorporated by reference.

In another embodiment, the acylating agents are prepared by reacting one or more of polyalkene with an excess of maleic anhydride to provide substituted succinic acylating agents wherein the number of succinic groups for each equivalent weight of substituent group, i.e., polyalkenyl group, is at least 1.3. The maximum number will generally not exceed 4.5. A suitable range is from about 1.4 to 3.5 and or from about 1.4 to about 2.5 succinic groups per equivalent weight of substituent groups.

The above-described carboxylic acylating agents are reacted with amines to form the acylated nitrogen dispersants.

Acylated nitrogen dispersants and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents is hereby incorporated by reference.

The borated dispersant may also be derived from hydrocarbyl-substituted amines. These hydrocarbyl-substituted amines are well known to those skilled in the art. These amines are disclosed in U.S. Pat. No. 3,275,554; 3,438,757; 3,454,555; 3,565,804; 3,755,433; and 3,822,289. These patents are hereby incorporated by reference for their disclosure of hydrocarbyl amines and methods of making the same.

Typically, hydrocarbyl substituted amines are prepared by reacting olefins and olefin polymers (polyalkenes) with amines (mono- or polyamines). The polyalkene may be any of the polyalkenes described above. The amines may be any of the amines described above. Examples of hydrocarbyl substituted amines include poly(propylene)amine; N,N-dimethyl-N-poly(ethylene/propylene)amine, (50:50 mole ratio of monomers); polybutene amine; N,N-di (hydroxyethyl)-N-polybutene amine; N-(2-hydroxypropyl)-N-polybutene amine; N-polybutene-aniline; N-polybutenemorpholine; N-poly(butene)ethylenediamine; N-poly(propylene)trimethylenediamine; N-poly(butene) diethylenetriamine; N',N'-poly(butene) tetraethylenepentamine; N,N-dimethyl-N'-poly(propylene)-1,3-propylenediamine and the like.

In another embodiment, the borated dispersant may also be derived from a carboxylic ester dispersant. The carboxylic ester dispersant is prepared by reacting at least one of the above hydrocarbyl-substituted carboxylic acylating agents with at least one organic hydroxy compound and optionally an amine. In another embodiment, the carboxylic ester dispersant is prepared by reacting the acylating agent with at least one of the above-described hydroxyamine.

The organic hydroxy compound includes compounds of the general formula $R''(OH)_m$ wherein R" is a monovalent or polyvalent organic group joined to the —OH groups through a carbon bond, and m is an integer of from 1 to about 10 wherein the hydrocarbyl group contains at least about 8 aliphatic carbon atoms. The hydroxy compounds may be aliphatic compounds, such as monohydric and polyhydric alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived generally contain up to about 40 aliphatic carbon atoms, or from 2 to about 30, or from 2 to about 10. They may be monohydric alcohols such as methanol, ethanol, isooctanol, dodecanol, cyclohexanol, etc. In one embodiment, the hydroxy compounds are polyhydric alcohols, such as alkylene polyols. Preferably, the polyhydric alcohols contain from 2 to about 40 carbon atoms, from 2 to about 20; and or from 2 to about 10 hydroxyl groups, or from 2 to about 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, or from about 8 to about 18, provided that at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic, oleic, stearic, linoleic, dodecanoic and tall oil acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of the carboxylic acylating agents described above with one or more alcohols or phenols in ratios of from about 0.5 equivalent to about 4 equivalents of hydroxy compound per equivalent of acylating agent. The esterification is usually carried out at a temperature above about 100° C., or between 150° C. and 300° C. The water formed as a by-product is removed by distillation as the esterification proceeds. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines. The amine is added in an amount sufficient to neutralize any nonesterified carboxyl groups. In one embodiment, the nitrogen-containing carboxylic ester dispersants are prepared by reacting about 1.0 to 2.0 equivalents, preferably about 1.0 to 1.8 equivalents of hydroxy compounds, and up to about 0.3 equivalent, or about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

In another embodiment, the borated dispersant may also be derived from a Mannich dispersant. Mannich dispersants are generally formed by the reaction of at least one aldehyde, at least one of the above described amine and at least one alkyl substituted hydroxyaromatic compound. The reaction may occur from room temperature to 225° C., usually from 50° to about 200° C. (with from 75° C.–150° C. most preferred), with the amounts of the reagents being such that the molar ratio of hydroxyaromatic compound to formaldehyde to amine is in the range from about (1:1:1) to about (1:3:3).

The first reagent is an alkyl substituted hydroxyaromatic compound. This term includes phenols (which are preferred), carbon-, oxygen-, sulfur- and nitrogen-bridged phenols and the like as well as phenols directly linked through covalent bonds (e.g. 4,4'-bis(hydroxy)biphenyl), hydroxy compounds derived from fused-ring hydrocarbon (e.g., naphthols and the like); and polyhydroxy compounds such as catechol, resorcinol and hydroquinone. Mixtures of one or more hydroxyaromatic compounds can be used as the first reagent.

The hydroxyaromatic compounds are those substituted with at least one, and preferably not more than two, aliphatic or alicyclic groups having at least about 6 (usually at least about 30, or from at least 50) carbon atoms and up to about 400 carbon atoms, preferably up to about 300, or up to about 200. These groups may be derived from the above described polyalkenes. In one embodiment, the hydroxy aromatic compound is a phenol substituted with an aliphatic or alicyclic hydrocarbon-based group having an $\overline{M}n$ of about 420 to about 10,000.

The second reagent is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaidehyde, paraldehyde, formalin and methal. Formaldehyde and its precursors (e.g., paraformaldehyde, trioxane) are preferred. Mixtures of aldehydes may be used as the second reagent.

The third reagent is any amine described above. Preferably the amine is a polyamine as described above. Mannnich dispersants are described in the following patents: U.S. Pat. Nos. 3,980,569; 3,877,899; and 4,454,059 (herein incorporated by reference for their disclosure to Mannich dispersants).

The following example relate to borated dispersants.

EXAMPLE BD-1

A mixture of 372 grams (6 equivalents of boron) of boric acid and 3111 grams (6 equivalents of nitrogen) of an acylated nitrogen composition, obtained by reacting 1 equivalent of a polybutenyl (n=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours and then filtered. The filtrate is found to have a boron content of 1.64% and a nitrogen content of 2.56%.

EXAMPLE BD-2

Boric acid (124 grams, 2 equivalents of boron) is added to the acylated nitrogen composition (556 grams, 1 equivalent of nitrogen) of Example D-17. The resulting mixture is heated at 150° C. for 3.5 hours and filtered at that temperature. The filtrate is found to have a boron compound of 3.23% and a nitrogen content of 2.3%.

EXAMPLE BD-3

(a) A reaction vessel is charged with 1000 parts of a polybutenyl ($\overline{M}n$=1000) substituted succinic anhydride, having a total acid number of 108, with a mixture of 275 grams of oil and 139 parts of a commercial mixture of polyamines corresponding to 85% E-100 amine bottoms and 15% diethylenetriamine. The reaction mixture is heated to 150 to 160° C. and the reaction temperature is maintained for four hours. The reaction is blown with nitrogen to remove water.

(b) A reaction vessel is charged with 1405 parts of the product of Example C-3a, 229 parts of boric acid, and 398 parts of diluent oil. The mixture is heated to 100 to 150° C. and the temperature maintained until water distillate ceases. The final product contains 2.3% nitrogen, 1.9% boron, 33% 100 neutral mineral oil and a total base number of 60.

Top Treatments

As described above the above saturated fatty phosphate esters or salts, alone or in combination with a fatty imidazoline or a reaction product of a fatty carboxylic acid and a polyalkylenepolyamine. In one embodiment, the phosphate ester or salt is used in combination with the fatty imidazoline or reaction product of the fatty carboxylic acid and the polyalkylene. In another embodiment the phosphate ester or salt is used in combination with the boron compound, such as a borated dispersant. Finally, all components may be used together.

The top treatments may be added to existing lubricants, such as gear and transmission lubricants. These top treatments increase the frictional properties and/or thermal stability properties of the lubricants. The lubricants are typically packages of additives which meet the API GL-4 or GL-5 and MIL-PRF-2105E requirements. The lubricants may contain, for example only, sulfur compounds such as organic sulfides, including organic polysulfide. The sulfur compounds include sulfurized oils and olefins. The lubricants may contain phosphorus compounds such as metal (e.g. zinc) thiophosphates, including dithiophosphates. Phosphoric acids, esters and salts may also be present. The top treatments are used at a level of about 0.5% to about 8%, or from about 0.75% to about 6%, or from about 1% to about 5%. These top treatments may be added to existing commercial lubricants such as Mobil's GT-2, Ethyl's E-385 and E-388, and Lubrizol's Ang 99 and Ang 6043 series.

The following examples relates to the top treatments of this invention.

| | A | B | C | D | E | F |
|---|---|---|---|---|---|---|
| $C_{12-14}$ amine phosphate[1] | 100 | 50 | 40 | 50 | 50 | 30 |
| Product of Example 1–2 | — | — | 7 | 5 | 5 | 10 |
| Product of Example BO-3b | — | 25 | — | — | 25 | 15 |
| Diluent oil | — | 25 | 53 | 45 | 20 | 45 |

[1]A Primene 81R amine salt of a hydrocarbyl phosphate prepared by reacting phosphorus pentoxide with Alfol 8–10 alcohol mixture The above top treatment may be added to lubricants at 2%–4% by weight.

Lubricants

The present invention also include lubricants. The lubricants comprise a fatty saturated phosphate ester or salt, at least one organic polysulfide, and a phosphorus antiwear or extreme pressure agent. In one embodiment, the lubricating composition is free of saturated fatty phosphites. In another embodiment, the lubricating compositons also includes one or more of the above fatty imidazolines or reaction products of a fatty carboxylic acid and a polyamine. In this embodiment, the lubricant may include a fatty saturated phosphite. In another embodiment, the lubricating composition may include at least one borated dispersant. The lubricating compositions may also include both the fatty imidazoline or reaction product and a corated disperant.

Polysulfides

The lubricating compositions may include an organic polysulfide. Generally, the organic polysulfide is used in an amount from about 0.5% up to about 8%, or from about 1% up to about 5%, or from about 2% up to about 4% by weight of the lubricating composition.

The organic polysulfides are generally characterized as having sulfur-sulfur linkages. Typically the linkages have from 2 to about 10 sulfur atoms, or from 2 to about 6 sulfur atoms, or from 2 to about 4 sulfur atoms. In one embodiment, the organic polysulfides are generally di-, tri- or tetrasulfide compositions, with trisulfide compositions preferred. In another embodiment, the polysulfide is a mixture where the majority of the compounds in the mixture are tri- or tetrasulfides. Still, in another embodiment, the polysulfide is a mixture of compounds where at least 60%, or at least about 70%, or at least about 80% of the compounds are trisulfide.

The organic polysulfides provide from about 1% to about 3% by weight sulfur to the lubricating compositions. Generally, the organic polysulfides contain from about 10% to about 60% sulfur, or from about 20% to about 50%, or from about 35% to about 45% by weight sulfur.

Materials which may be sulfurized to form the organic polysulfides include oils, fatty acids or esters, or olefins, or polyolefins. Oils which may be sulfurized are natural or synthetic oils including mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids generally contain from about 8 to about 30, or from about 12 to about 24 carbon atoms. Examples of fatty acids include oleic, linoleic, linolenic, tall oil and rosin acids. Sulfurized fatty acid esters prepared from mixed unsaturated fatty acid esters such as are obtained from animal fats and vegetable oils, including tall oil, linseed oil, soybean oil, rapeseed oil, and fish oil, are also useful.

The olefinic compounds which may be sulfurized are diverse in nature. They contain at least one olefinic double bond, which is defined as a non-aromatic double bond. In its broadest sense, the olefin may be defined by the formula; $R^{*1}R^{*2}C{=}CR^{*3}R^{*4}$, wherein each of $R^{*1}$, $R^{*2}$, $R^{*3}$ and $R^{*4}$ is hydrogen or an organic group. In general, the R groups in the above formula which are not hydrogen may be satisfied by such groups as $—C(R^{*5})_3$, $—COOR^{*5}$, $—CON(R^{*5})_2$, $—COON(R^{*5})_4$, —COOM, —CN, —X, $—YR^{*5}$ or —Ar, wherein: each $R^{*5}$ is independently hydrogen, alkyl, alkenyl, aryl, substituted alkyl, substituted alkenyl or substituted aryl, with the proviso that any two $R^{*5}$ groups can be alkylene or substituted alkylene whereby a ring of up to about 12 carbon atoms is formed; M is one equivalent of a metal cation (or a Group I or II metal cation, e.g., sodium, potassium, barium, or calcium cation); X is halogen (e.g., chloro, bromo, or iodo); Y is oxygen or divalent sulfur; Ar is an aryl or substituted aryl group of up to about 12 carbon atoms. Any two of $R^{*1}$, $R^{*2}$, $R^{*3}$ and $R^{*4}$ may also together form an alkylene or substituted alkylene group; i.e., the olefinic compound may be alicyclic.

The olefinic compound is usually one in which each $R^*$ group which is not hydrogen is independently alkyl, alkenyl or aryl group. Monoolefinic and diolefinic compounds, particularly the former, are preferred, and especially terminal monoolefinic hydrocarbons; that is, those compounds in which $R^{*3}$ and $R^{*4}$ are hydrogen and $R^{*1}$ and $R^{*2}$ are a hydrocarbyl group having from 1 to about 30, or from 1 to about 16, or from 1 to about 8, or from 1 to about 4 carbon atoms. Olefinic compounds having about 3 to about 30 and especially about 3 to about 16 (most often less than about 9) carbon atoms are particularly desirable. In one embodiment, the organic polysulfide comprises a sulfurized olefin, such as those described above for the polyalkene.

The organic polysulfides may be prepared by the sulfochlorination of olefins containing four or more carbon atoms and further treatment with inorganic higher polysulfides according to U.S. Pat. No. 2,708,199.

In another embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced.

In another embodiment, the sulfurized olefins may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. Nos. 4,119,549, 4,119,550, 4,191,659, and 4,344,854, the disclosures of which are hereby incorporated by reference for their description of the preparation of useful sulfurized compositions.

The following example relates to organic polysulfides.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

Phosphorus Extreme Pressure Agent

As described above, the lubricating compositions may also include a phosphorus containing antiwear or extreme pressure agent, such as a phosphoric acid ester or salt thereof (diferent from the above described saturated fatty phosphate ester or salt), a lower alkyl phosphite, a phosphorus-containing carboxylic acid, ester, ether, or amide, and mixtures thereof. In this embodiment, the phosphorus containing antiwear or extreme pressure agent is present in an amount sufficient to impart antiwear, antiweld, or extreme pressure properties to the lubricants and functional fluids. Generally, each phosphorus antiwear or extreme pressure agent is present in an amount from about 0.5% to about 4%, or from about 0.8% to about 3%, or from about 0.9% to about 1.8% by weight of the lubricating composition. The phosphorus acids include the phosphoric, phosphonic, phosphinic and thiophosphoric acids including dithiophosphoric acid, as well as the monothiophosphoric acid, thiophosphinic and thiophosphonic acids.

In one embodiment, phosphorus containing antiwear or extreme pressure agent is a phosphorus acid ester prepared by reacting one or more phosphorus acid or anhydride with an alcohol containing from one to about 30, or from two to about 24, or from about 3 to about 12 carbon atoms. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. The phosphorus acid ester may be a mono-, di- or trihydrocarbyl phosphoric acid ester. Alcohols used to prepare the phosphorus acid esters include butyl, amyl, 2-ethylhexyl, hexyl, octyl, and oleyl alcohols, and phenols, such as cresol. Examples of commercially available alcohols include Alfol 810 (a mixture of primarily straight chain, primary alcohols having from 8 to 10 carbon atoms); and the above described commercial alcohols, including Alfol, Adol, and Neodol alcohols.

Examples of useful phosphorus acid esters include the phosphoric acid esters prepared by reacting a phosphoric acid or anhydride with cresol. An example of these phosphorus acid esters is tricresylphosphate.

In another embodiment, the phosphorus antiwear or extreme pressure agent is a thiophosphorus acid ester or salt thereof. The thiophosphorus acid esters may be prepared by reacting phosphorus sulfides, such as those described above, with alcohols, such as those described above. The thiophosphorus acid esters may be mono- or dithiophosphorus acid esters. Thiophosphorus acid esters are also referred to generally as dialkyl thiophosphoric acids.

In one embodiment, the phosphorus acid ester is a monothiophosphoric acid ester or a monothiophosphate. Monothiophosphates may be prepared by the reaction of a sulfur source with a dihydrocarbyl phosphite. The sulfur source may for instance be elemental sulfur. The sulfur source may also be a sulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638, which are incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate.

In another embodiment, the phosphorus antiwear or extreme pressure agent is a dithiophosphoric acid or phosphorodithioic acid. The dithiophosphoric acid may be represented by the formula $(R_{11}O)_2PSSH$ wherein each $R_{11}$ is independently a hydrocarbyl group containing from about 3 to about 30, preferably from about 3 up to about 18, or from about 3 up to about 12, or from up to about 8 carbon atoms. Examples $R_{11}$ include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl $R_{11}$ groups include butylphenyl, amylphenyl, heptylphenyl, etc. Examples of mixtures of $R_{11}$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

In one embodiment, the dithiophosphoric acid may be reacted with an epoxide or a polyhydric alcohol, such as glycerol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Ethylene oxide and propylene oxide are preferred. The polyhydric alcohols are described above. The glycols may be aliphatic glycols having from 1 to about 12, or from about 2 to about 6, or from 2 or 3 carbon atoms. Glycols include ethylene glycol, propylene glycol, and the like. The dithiophosphoric acids, glycols, epoxides, inorganic phosphorus reagents and methods of reacting the same are described in U.S. Pat. Nos. 3,197,405 and 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2pentyl)phosphorodithioate (prepared by reacting di(4-methyl-2pentyl)-phosphorodithioic acid with 1.3 moles of propylene oxide at 25° C.). The mixture is heated at 75° C. for 2.5 hours, mixed with a diatomaceous earth and filtered at 70° C. to obtain the desired product. The product has by analysis 11.8% by weight phosphorus, 15.2% by weight sulfur, and an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate has by analysis 15.3% by weight phosphorus, 19.6% by weight sulfur, and an acid number of 126 (bromophenol blue).

Acidic phosphoric acid esters may be reacted with an amine compound or a metallic base to form an amine or a metal salt. The amines are described above. In one embodiment, the amines are tertiary monoamines. Tertiary 20 monoamines include trimethylamine, tributylamine, methyidiethylamine, ethyldibutylamine, etc. In another embodiment, the amine is one or more of the above described tertiary aliphatic primary amines. The salts may be formed separately and then the salt of the phosphorus acid ester may be added to the lubricating composition. Alternatively, the salts may also be formed in situ when the acidic phosphorus acid ester is blended with other components to form a fully formulated lubricating composition.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

In one embodiment, phosphorus containing antiwear or extreme pressure agent is a metal thiophosphate, preferably a metal dithiophosphate. The metal thiophosphate is prepared by means known to those in the art, and may be prepared from one or more of the above thiophosphoric acids. Examples of metal dithiophosphates include zinc isopropyl methylamyl dithiophosphate, zinc isopropyl isooctyl dithiophosphate, barium di(nonyl) dithiophosphate, zinc di(cyclohexyl) dithiophosphate, zinc di(isobutyl) dithiophosphate, calcium di(hexyl) dithiophosphate, zinc isobutyl isoamyl dithiophosphate, and zinc isopropyl secondary-butyl dithiophosphate.

The following Examples P-3 to P-6 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atom, is added over a period of 20 minutes at 25–60° C. The resulting product has by analysis a phosphorus content of 10.2% by weight, a nitrogen content of 1.5% by weight, and an acid number of 26.3.

EXAMPLE P-4

The filtrate of Example P-2 (1752 grams) is mixed at 25–82° C. with 764 grams of the aliphatic primary amine used in of Example P-3. The resulting product has by analysis 9.95% phosphorus, 2.72% nitrogen, and 12.6% sulfur.

EXAMPLE P-5

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has by analysis 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60–70° C. under a pressure of 30 mm Hg. The resulting product mixture is filtered using a diatomaceous earth. The filtrate has 8.58% zinc and 7.03% phosphorus.

EXAMPLE P-6

Phosphorus pentoxide (208 grams) is added to the product prepared by reacting 280 grams of propylene oxide with 1184 grams of O,O'-di-isobutylphosphorodithioic acid at 30–60° C. The addition is made at a temperature of 50–60° C. and the resulting mixture is then heated to 80° C. and held at that temperature for 2 hours. The commercial aliphatic primary amine identified in Example P-3 (384 grams) is added to the mixture, while the temperature is maintained in the range of 30–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, the phosphorus antiwear or extreme pressure agent is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula $R_{12}COOH$, wherein $R_{12}$ is an aliphatic or alicyclic hydrocarbyl group preferably free from acetylenic unsaturation. $R_{12}$ generally contains from about 2, or from about 4 carbon atoms. $R_{12}$ generally contains up to about 40, or up to about 24, or to up about 12 carbon atoms. In one embodiment, $R_{12}$ contains from 4, or from about 6 up to about 12, or up to about 8 carbon atoms. In one embodiment, $R_{12}$ is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids and linoleic acid dimer. A preferred carboxylic acid is 2-ethylhexanoic acid.

The metal salts may be prepared by merely blending a metal salt of a dithiophoshoric acid with a metal salt of a carboxylic acid in the desired ratio. The ratio of equivalents of dithiophosphoric acid to carboxylic acid is from about 0.5 up to about 400 to 1. The ratio may be from 0.5 up to about 200, or to about 100, or to about 50, or to about 20 to 1. In one embodiment, the ratio is from 0.5 up to about 4.5 to one, or from about 2.5 up to about 4.25 to one. For this purpose, the equivalent weight of a dithiophosphoric acid is its molecular weight divided by the number of -PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

In another embodiment, the phosphorus containing antiwear or extreme pressure agent is a lower alkyl phosphite. The phosphite may be a di- or trihydrocarbyl phosphite. Generally, each alkyl group independently has from 1 to about 7, or from two to about 6, or from about 2 to about 5 carbon atoms. Examples of specific hydrocarbyl groups include propyl, butyl, hexyl, and heptyl. Phosphites and their preparation are known and many phosphites are available commercially. Particularly useful phosphite is dibutyl phosphite.

In one embodiment, the phosphorus containing antiwear or extreme pressure agent is a phosphorus containing amide. The phosphorus containing amides are prepared by the reaction of one of the above described phosphorus acids, preferably a dithiophosphoric acid, with an unsaturated amide. Examples of unsaturated amides include acrylamide, N,N'-methylene bis(acrylamide), methacrylamide, crotonamide, and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374 which are incorporated by reference for their disclosures of phosphorus amides and their preparation.

In one embodiment, the phosphorus antiwear or extreme pressure agent is a phosphorus containing carboxylic ester. The phosphorus containing carboxylic esters are prepared by reaction of one of the above-described phosphorus acids, preferably a dithiophosphoric acid, and an unsaturated carboxylic acid or ester. Examples of unsaturated carboxylic acids and anhydrides include acrylic acid or esters, methacrylic acid or esters, itaconic acid or esters, fumaric acid or esters, and maleic acid, anhydride, or esters.

The ester may be represented by one of the formulae: $R_{13}C{=}C(R_{14})C(O)OR_{15}$, or $R_{15}O{-}(O)C{-}HC{=}CH{-}C$ $(O)OR_{15}$, wherein each $R_{13}$ and $R_{15}$ are independently hydrogen or a hydrocarbyl group having 1 to about 18, or to about 12, or to about 8 carbon atoms, $R_{14}$ is hydrogen or an alkyl group having from 1 to about 6 carbon atoms. In one embodiment, $R_{13}$ is preferably hydrogen or a methyl group.

Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl-acrylate, ethyl maleate, butyl maleate and 2-ethylhexyl maleate. The above list includes mono- as well as diesters of maleic, fumaric and citraconic acids. If the carboxylic acid is used, the ester may then be formed by subsequent reaction of the phosphoric acid-unsaturated carboxylic acid adduct with an alcohol, such as those described herein.

In one embodiment, the phosphorus containing antiwear or extreme pressure agent is a reaction product of a phosphorus acid, preferably a dithiophosphoric acid, and a vinyl ether. The vinyl ether is represented by the formula $R_{16}$—$CH_2$=CH—$OR_{17}$ wherein $R_{16}$ is independently hydrogen or a hydrocarbyl group having from 1 up to about 30, or up to about 24, or from up to about 12 carbon atoms. $R_{17}$ is a hydrocarbyl group defined the same as $R_{16}$. Examples of vinyl ethers include methyl vinyl ether, propyl vinyl ether, 2-ethylhexyl vinyl ether and the like.

In one embodiment, the phosphorus containing antiwear or extreme pressure agent is a reaction product of a phosphorus acid, or a dithiophosphoric acid, and a vinyl ester. The vinyl ester may be represented by the formula $R_{18}$CH=CH—O(O)$CR_{19}$, wherein $R_{18}$ is a hydrocarbyl group having from 1 to about 30, or to about 12 carbon atoms, preferably hydrogen, and $R_{19}$ is a hydrocarbyl group having 1 to about 30, or to about 12, or to about 8 carbon atoms. Examples of vinyl esters include vinyl acetate, vinyl 2-ethylhexanoate, vinyl butanoate, etc.

Borated Overbased Metal Salts

The lubricating compositions may also include a borated overbased metal salts are prepared by either reacting a boron compound with an overbased metal salt or by using a boron compound, such as boric acid, to prepare the overbased metal salt. Generally, the borated overbased metal salts is present in an amount from about 0.5% to about 4%, or from about 0.7% to about 3%, or from about 0.9% to about 2% by weight of the lubricating composition.

The boron compounds include boron oxide, boron oxide hydrate, boron trioxide, boron acids, such as boronic acid (i.e., alkyl-$B(OH)_2$ or aryl-$B(OH)_2$), including methyl boronic acid, phenyl-boronic acid, cyclohexyl boronic acid, p-heptylphenyl boronic acid and dodecyl boronic acid, boric acid (i.e., $H_3BO_3$), tetraboric acid ( i.e., $H_2B_4O_7$), metaboric acid (i.e., $HBO_2$), boron anhydrides, boron amides and various esters of such boron acids.

In one embodiment, the boron compounds include mono-, di-, and tri-organic esters of boric acid and alcohols or phenols. Examples of the alcohols include methanol, ethanol, propanol, butanol, 1-octanol, benzyl alcohol, ethylene glycol, glycerol, and Cellosolve. Lower alcohols, having less than about 8 carbon atoms, and glycols, such as 1,2-glycols and 1,3-glycols, are especially useful. Methods for preparing the esters are known and disclosed in the art (such as "Chemical Reviews," pp. 959–1064, Vol. 56).

The above boron compounds may be reacted with an overbased metal salt. Overbased metal salts are characterized by having a metal content in excess of that which would be present according to the stoichiometry of the metal and the acidic organic compound. The amount of excess metal is commonly expressed in metal ratio. The term "metal ratio" is the ratio of the total equivalents of the metal to the equivalents of the acidic organic compound. A salt having a metal ratio of 4.5 will have 3.5 equivalents of excess metal. The overbased salts generally have a metal ratio from about 1.5 up to about 40, or from about 2 up to about 30, or from about 3 up to about 25. In one embodiment, the metal ratio is greater than about 7, or greater than about 10, or greater than about 15.

The overbased materials are prepared by reacting an acidic material, typically carbon dioxide, with a mixture comprising the acidic organic compound, a reaction medium comprising at least one inert, organic solvent for the acidic organic compound, a stoichiometric excess of a basic metal compound, and a promoter. Generally, the basic metal compounds are oxides, hydroxides, chlorides, carbonates, and phosphorus acids (phosphonic or phosphoric acid) salts, and sulfur acid (sulfuric or sulfonic) salts. The metals of the basic metal compounds are generally alkali, alkaline earth, and transition metals. Examples of the metals of the basic metal compound include sodium, potassium, lithium, magnesium, calcium, barium, titanium, manganese, cobalt, nickel, copper, zinc, preferably sodium, potassium, calcium, and magnesium.

The acidic organic compounds useful in making the overbased compositions of the present invention include carboxylic acylating agents, sulfonic acids, phosphorus containing acids, phenols, or mixtures of two or more thereof. Preferably, the acidic organic compounds are carboxylic acylating agents, or sulfonic acids. In one embodiment, the acidic organic compounds is a hydrocarbyl substituted acidic organic compound. The hydrocarbyl group may be derived from the above described polyalkene.

In one embodiment, the acidic organic compound is a carboxylic acylating agent. The carboxylic acylating agents may be mono- or polycarboxylic acylating agents. The carboxylic acylating agents include carboxylic acids, anhydrides, lower alkyl esters, acyl halides, lactones and mixtures thereof. The carboxylic acylating agents include the hydrocarbyl substituted carboxylic acylating agents where the hydrocarbyl group is derived from one or more of the above described olefins, olefin oligomers, or polyalkenes. The hydrocarbyl substituted carboxylic acylating agents are prepared by reacting the olefin, the olefin oligomer, such as tetrapropene or the polyalkene, such polybutene or polypropylene, with an unsaturated mono- or polycarboxylic reagent. Example of unsaturated carboxylic reagents include acrylic acid and esters, methacrylic acid and esters, itaconic acid and esters, fumaric acid and esters, and maleic acid, anhydride, or esters. In one embodiment, the hydrocarbyl substituted carboxylic acylating agent is a polyalkene substituted succinic acylating agent. The carboxylic acylating agents are known in the art and have been described in detail, for example, in the following U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference. These patents are incorporated herein by reference for their disclosure of carboxylic acylating agents and methods for making the same.

In another embodiment, the carboxylic acylating agents are aromatic carboxylic acids. A group of useful aromatic carboxylic acids are those of the formula

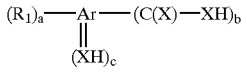

wherein $R_1$ is an aliphatic hydrocarbyl group having from about 4 to about 400 carbon atoms, a is a number in the range of zero to about 4, Ar is an aromatic group, each X is independently sulfur or oxygen, preferably oxygen, b is a number in the range of from 1 to about 4, c is a number in the range of zero to about 4, usually 1 to 2, with the proviso that the sum of a, b and c does not exceed the number of valences of Ar. Preferably, $R_1$ and a are such that there is an average of at least about 8 aliphatic carbon atoms provided by the $R_1$ groups.

The $R_1$ group is a hydrocarbyl group that is directly bonded to the aromatic group Ar. $R_1$ preferably contains from about 6 to about 80 carbon atoms, or from about 6 to about 30 carbon atoms, or from about 8 to about 25 carbon atoms, or from about 8 to about 15 carbon atoms. Examples of $R_1$ groups include butyl, isobutyl, pentyl, octyl, nonyl, dodecyl, 5-chlorohexyl, 4-ethoxypentyl, 3-cyclohexyloctyl, 2,3,5-trimethylheptyl, propylene tetramer, triisobutenyl and substituents derived from one of the above polyalkenes.

The aromatic group Ar may have the same structure as any of the aromatic groups Ar discussed below. Examples of the aromatic groups that are useful herein include the polyvalent aromatic groups derived from benzene, naphthalene, and anthracene, preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

In one embodiment, the salicylic acids are hydrocarbyl substituted salicylic acids, wherein each hydrocarbyl substituent contains an average of at least about 8 carbon atoms per substituent and 1 to 3 substituents per molecule. In one embodiment, the hydrocarbyl substituent is derived from the above-described polyalkenes.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

In another embodiment, the acidic organic compound used to make the borated overbased salt is a sulfonic acid. The sulfonic acids include sulfonic and thiosulfonic acids, preferably sulfonic acids. The sulfonic acids include the mono- or polynuclear aromatic or cycloaliphatic compounds. The oil-soluble sulfonic acids may be represented for the most part by one of the following formulae: $R_2$—T—$(SO_3)_a$H and $R_3$—$(SO_3)_b$H, wherein T is a cyclic nucleus such as benzene, naphthalene, anthracene, diphenylene oxide, diphenylene sulfide, and petroleum naphthenes; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

A preferred group of sulfonic acids are mono-, di-, and tri-alkylated benzene and naphthalene sulfonic acids including their hydrogenated forms. Illustrative of synthetically produced alkylated benzene and naphthalene sulfonic acids are those containing alkyl substituents having from about 8 to about 30 carbon atoms, or from about 12 to about 30 carbon atoms, and or to about 24 carbon atoms. Specific examples of sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatumsulfonic acids; mono- and polywax-substituted sulfonic acids; alkylbenzenesulfonic acids (where the alkyl group has at least 8 carbons), dilaurylbeta-naphthylsulfonic acids, and alkarylsulfonic acids such as dodecylbenzene "bottoms" sulfonic acids.

In another embodiment, the acidic organic compound is a phenol. The phenols may be represented by the formula $(R_4)_a$—Ar—$(OH)_b$, wherein $R_4$ is defined above; Ar is an aromatic group; a and b are independently numbers of at least one, the sum of a and b being in the range of two up to the number of displaceable hydrogens on the aromatic nucleus or nuclei of Ar. In one embodiment, a and b are each independently numbers in the range from 1 to about 4, or from 1 to about 2. In one embodiment, $R_4$ and a are such that there is an average of at least about 8 aliphatic carbon atoms provided by the $R_4$ groups for each phenol compound.

The aromatic group as represented by "Ar", as well as elsewhere in other formulae in this specification and in the appended claims, can be mononuclear, such as a phenyl, a pyridyl, or a thienyl, or polynuclear. The polynuclear groups can be of the fused or linked type. Examples of fused groups include naphthyl, and anthranyl. The linked groups have bridging linkages such as alkylene linkages, ether linkages, keto linkages, sulfide linkages, polysulfide linkages of 2 to about 6 sulfur atoms, etc.

Promoters are often used in preparing the overbased metal salts. The promoters, that is, the materials which facilitate the incorporation of the excess metal into the overbased material, are also quite diverse and well known in the art. A particularly comprehensive discussion of suitable promoters is found in U.S. Pat. Nos. 2,777,874, 2,695,910, 2,616,904, 3,384,586 and 3,492,231. These patents are incorporated by reference for their disclosure of promoters. In one embodiment, promoters include the alcoholic and phenolic promoters. The alcoholic promoters include the alkanols of one to about 12 carbon atoms, such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Acidic materials, which are reacted with the mixture of acidic organic compound, promoter, metal compound and reactive medium, are also disclosed in the above cited patents, for example, U.S. Pat. No. 2,616,904. Included within the known group of useful acidic materials are liquid acids, such as formic acid, acetic acid, nitric acid, boric acid, sulfuric acid, hydrochloric acid, hydrobromic acid, carbamic acid, substituted carbamic acids, etc. Acetic acid is a very useful acidic material although inorganic acidic compounds such as HCl, $SO_2$, $SO_3$, $CO_2$, $H_2S$, $N_2O_3$, etc., are ordinarily employed as the acidic materials. Particularly useful acidic materials are carbon dioxide and acetic acid.

The methods for preparing the overbased materials, as well as an extremely diverse group of overbased materials, are well known in the prior art and are disclosed, for example, in the following U.S. Pat. Nos.: 2,616,904; 2,616,905; 2,616,906; 3,242,080; 3,250,710; 3,256,186; 3,274,135; 3,492,231; and 4,230,586. These patents disclose processes, materials, which can be overbased, suitable metal bases, promoters, and acidic materials, as well as a variety of specific overbased products useful in producing the overbased systems of this invention and are, accordingly, incorporated herein by reference for these disclosures.

The temperature at which the acidic material is contacted with the remainder of the reaction mass depends to a large measure upon the promoting agent used. With a phenolic promoter, the temperature usually ranges from about 80° C. to about 300° C., and preferably from about 100° C. to about 200° C. When an alcohol or mercaptan is used as the promoting agent, the temperature usually will not exceed the reflux temperature of the reaction mixture and preferably will not exceed about 100° C.

The following examples relate to borated overbased metal salts and methods of making the same. Unless the context indicates otherwise, here as well as elsewhere in the specification and claims, parts and percentages are by weight, temperature is in degrees Celsius and pressure is atmospheric pressure.

EXAMPLE BO-1

(a) A mixture of 853 grams of methyl alcohol, 410 grams of blend oil, 54 grams of sodium hydroxide, and a neutralizing amount of additional sodium hydroxide is prepared. The amount of the latter addition of sodium hydroxide is dependent upon the acid number of the subsequently added sulfonic acid. The temperature of the mixture is adjusted to 49° C. 1070 grams of a mixture of straight chain dialkyl benzene sulfonic acid ($\overline{M}w$=430) and blend oil (42% by weight active content) are added while maintaining the temperature at 49–57° C. 145 grams of polyisobutenyl (number average $\overline{M}n$=950)-substituted succinic anhydride are added. 838 grams of sodium hydroxide are added. The temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35% by weight.

(b) A mixture of 1000 grams of the product from Example BO-1(a) above, 0.13 gram of an antifoaming agent (kerosene solution of Dow Corning 200 Fluid having a viscosity of 1000 cSt at 25° C.), and 133 grams of blend oil is heated to 74–79° C. with stirring. 486 grams of boric acid are added. The reaction mixture is heated to 121° C. to liberate water of reaction and 40–50% by weight of the $CO_2$ contained in the product from Example BO-1(a). The reaction mixture is heated to 154–160° C. and maintained at that temperature until the free and total water contents are reduced to 0.3% by weight or less and approximately 1–2% by weight, respectively. The reaction product is cooled to room temperature and filtered.

EXAMPLE BO-2

(a) A mixture of 1000 grams of a primarily branched chain monoalkyl benzene sulfonic acid ($\overline{M}w$=500), 771 grams of o-xylene, and 75.2 grams of polyisobutenyl (number average $\overline{M}n$=950) succinic anhydride is prepared and the temperature is adjusted to 46° C. 87.3 grams of magnesium oxide are added. 35.8 grams of acetic acid are added. 31.4 grams of methyl alcohol and 59 grams of water are added. The reaction mixture is blown with 77.3 grams of carbon dioxide at a temperature of 49–54° C. 87.3 grams of magnesium oxide, 31.4 grams of methyl alcohol and 59 grams of water are added, and the reaction mixture is blown with 77.3 grams of carbon dioxide at 49–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.3% by weight, a metal ratio 14.7, a sulfate ash content of 46.0%, and a sulfur content of 1.6% by weight.

(b) A mixture of 1000 grams of the product from Example BO-2(a) and 181 grams of diluent oil is heated to 79° C. Boric acid (300 grams) is added and the reaction mixture is heated to 124° C. over a period of 8 hours. The reaction mixture is maintained at 121–127° C. for 2–3 hours. A nitrogen sparge is started and the reaction mixture is heated to 149° C. to remove water until the water content is 3% by weight or less. The reaction mixture is filtered to provide the desired product. The product contains 7.63% magnesium and 4.35% boron.

EXAMPLE BO-3

(a) A reaction vessel is charged with 281 parts (0.5 equivalent) of a polybutenyl-substituted succinic anhydride derived from a polybutene ($\overline{M}n$=1000), 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 scfh and the reaction temperature is increased to 148° C. The reaction mixture is then blown with carbon dioxide at 1 scfh for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 scfh. The reaction temperature is increased to 140° C. where the reaction mixture is blown with carbon dioxide at 1 scfh for 1 hour and 25 minutes while 150 parts of water is collected. The reaction temperature is decreased to 100° C. and 272 parts (3.4 equivalents) of the above sodium hydroxide solution is added while blowing the mixture with nitrogen at 1 scfh. The reaction temperature is increased to 148° C. and the reaction mixture is blown with carbon dioxide at 1 scfh for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth. The filtrate contains 50.0% sodium sulfate ash (theoretical 53.8%) by ASTM D-874, total base number of 408, a specific gravity of 1.18 and 37.1% oil.

(b) A reaction vessel is charged with 700 parts of the product of Example BO-3(a). The reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 scfh at 160° C. for 30 minutes while 95 parts of water is collected. Xylene (200 parts) is added to the reaction mixture and the reaction temperature is maintained at 130–140° C. for 3 hours. The reaction mixture is vacuum stripped at 150° C. and 20 millimeters of mercury. The residue is filtered through diatomaceous earth. The filtrate contains 5.84% boron (theoretical 6.43) and 33.1% oil. The residue has a total base number of 309.

EXAMPLE BO-4

A sodium carbonate overbased (20:1 equivalent) sodium sulfonate (1000 parts, 7.84 equivalents) is mixed with 130 parts of 100 neutral mineral oil in a reaction vessel. The mixture of the sodium carbonate overbased sodium sulfonate and the mineral oil is heated to 75° C. Boric acid (486 parts, 7.84 moles) is then added slowly without substantially changing the temperature of the mixture.

The reaction mixture is then slowly heated to 100° C. over a period of about 1 hour while removing substantially all of the distillate. About one-half of the carbon dioxide is removed, without substantial foaming. The product is then further heated to 150° C. for about 3 hours while removing all of the distillate. It is observed that at the latter temperature, substantially all of the water is removed and very little additional carbon dioxide is evolved from the product. The product is then held for another hour at 150° C. until the water content of the product is less than about 0.3%. The product is recovered by allowing it to cool to 100° C.–120° C. followed by filtration. The filtrate has 6.12% boron, 14.4% Na, and 35% 100 neutral mineral oil.

Other Additives

The invention also contemplates the use of other additives together in the lubricating compositions. The other additives may include one or more of the above described additive where the embodiment does not already require its presence. Such additives include, for example, detergents and dispersants, corrosion- and oxidation-inhibiting agents, pour point depressing agents, extreme pressure agents, antiwear agents, color stabilizers and anti-foam agents. Generally, the additives are independently present in an amount from about 0.1% to about 3%, or from about 0.2% to about 2%, or from about 0.3% to about 1% by weight of the lubricating composition.

The dispersants include (a) acylated nitrogen dispersants, (b) hydrocarbyl substituted amines, (c) carboxylic ester dispersants, (d) Mannich dispersants, and (e) mixtures thereof. The acylated nitrogen dispersant include reaction products of one or more of the above described carboxylic acylating agents such as the hydrocarbyl substituted carboxylic acylating agents and an amine. In one embodiment, the hydrocarbyl groups are derived from one or more of the above polyalkenes. The above-described carboxylic acylating agents are reacted with amines to form the acylated nitrogen dispersants. The amines may be monoamines or polyamines. Useful amines include those amines disclosed in U.S. Pat. No. 4,234,435 at Col. 21, line 4 to Col. 27, line 50, these passages being incorporated herein by reference. Acylated nitrogen dispersants and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents is hereby incorporated by reference.

The may also be derived from hydrocarbyl-substituted amines. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same. Typically, hydrocarbyl substituted amines are prepared by reacting olefins and olefin polymers (polyalkenes) with amines (mono- or polyamines).

In another embodiment, the dispersant may also be derived from a carboxylic ester dispersant. The carboxylic ester dispersant is prepared by reacting at least one of the above hydrocarbyl-substituted carboxylic acylating agents with at least one organic hydroxy compound and optionally an amine. In another embodiment, the carboxylic ester dispersant is prepared by reacting the acylating agent with at least one of the above-described hydroxyamine. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

In another embodiment, the borated dispersant may also be derived from a Mannich dispersant. Mannich dispersants are generally formed by the reaction of at least one aldehyde, at least one of the above described amine and at least one alkyl substituted hydroxyaromatic compound. Mannnich dispersants are described in the following patents: U.S. Pat. Nos. 3,980,569; 3,877,899; and 4,454,059 (herein incorporated by reference for their disclosure to Mannich dispersants).

The detergents are exemplified by oil-soluble neutral and basic salts (i.e. overbased salts) of alkali or alkaline earth metals with sulfonic acids, carboxylic acids, phenols or organic phosphorus acids, such as those described above. The oil-soluble neutral or basic salts of alkali or alkaline earth metal salts may also be reacted with a boron compound. Boron compounds are described above.

Auxiliary extreme pressure agents and corrosion- and oxidation-inhibiting agents which may be included in the lubricants of the invention are exemplified by chlorinated aliphatic hydrocarbons such as chlorinated wax; sulfurized alkylphenol; phosphosulfurized hydrocarbons, such as the reaction product of a phosphorus sulfide with turpentine or methyl oleate; metal thiocarbamates, such as zinc dioctyldithiocarbamate, and barium diheptylphenyl dithiocarbamate; dithiocarbamate esters, such as reaction products of an amine (e.g., butylamine), carbon disulfide, and an unsaturated compound selected from acrylic, methacrylic, maleic, or fumaric acids, esters, or salts and acrylamides; and alkylene- or bis (S-alkyl dithiocarbamoyl) disulfides (also known as sulfur-coupled dithiocarbamate), such as methylene or phenylene coupled bis (dibutyidithiocarbamates). Examples of additional antiwear or extreme pressure agents include an alkali metal borate; a borated fatty amine; a borated phospholipid; and a borate ester.

In another embodiment, the boron containing antiwear or extreme pressure agent is an alkali metal borate. Alkali metal borates are generally a hydrated particulate alkali metal borate which are known in the art. Alkali metal borates include mixed alkali and alkaline earth metal borates. These alkali metal borates are available commercially. Representative patents disclosing suitable alkali metal borates and their methods of manufacture include U.S. Pat. Nos. 3,997,454; 3,819,521; 3,853,772; 3,907,601; 3,997,454; and 4,089,790. These patents are incorporated by reference for their disclosures of alkali metal borates and methods of their manufacture.

In another embodiment, the boron antiwear or extreme pressure agent is a borated fatty amine. The borated amines are prepared by reacting one or more of the above boron compounds, such as boric acid or borate ester, with a fatty amine, e.g. an amine having from about four to about eighteen carbon atoms. The borated fatty amines are prepared by reacting the amine with the boron compound at about 50° C. to about 300° C., or from about 100° C. to about 250° C., and at a ratio of 3:1 to 1:3 equivalents of amine to equivalents of boron compound.

In another embodiment, the boron containing antiwear or extreme pressure agent is a borated epoxide. The borated fatty epoxides are generally the reaction product of one or more of the above boron compounds, with at least one epoxide. The epoxide is generally an aliphatic epoxide having from about 8 up to about 24, or from about 10 to about 22, or from about 12 to about 20 carbon atoms. Examples of useful aliphatic epoxides include heptyl oxide, octyl oxide, stearyl oxide, oleyl oxide and the like. Mixtures of epoxides may also be used, for instance commercial mixtures of epoxides having from 14 to about 16 carbon atoms and 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In another embodiment, the boron containing antiwear or extreme pressure agent is a borated phospholipid. The borated phospholipids are prepared by reacting a combination of a phospholipid and a boron compound. Optionally, the combination may include an amine, an acylated nitrogen compound, such as reaction products of carboxylic acrylating agents and polyamines, a carboxylic ester, such as reaction products of carboxylic acrylating agents and alcohols and optionally amines, a Mannich reaction product, or a basic or neutral metal salt of an organic acid compound. Phospholipids, sometimes referred to as phosphatides and phospholipins, may be natural or synthetic. Naturally derived phospholipids include those derived from fish, fish oil, shellfish, bovine brain, chicken eggs, sunflowers, soybean, corn, and cottonseed. Phospholipids may be derived from microorganisms, including blue-green algae, green algae, and bacteria.

The reaction of the phospholipid, the boron compound, and the optional components usually occurs at a temperature from about 60° C., or about 90° C. up to about 200° C., up to about 150° C. The reaction is typically accomplished in about 0.5, or about 2 up to about 10 hours. Generally, from one equivalent to about three equivalents of the phospholipid are reacted with each boron atom of the boron compound. An equivalent of phospholipid is determined by the number of phosphorus atoms in the phospholipid. The equivalent of boron compound is determined by the number of boron atoms in the boron compound. When a combination of a phospholipid and an additional component, then one atom of the boron compound is reacted with from one to about three equivalents of the combination. The equivalents of the combination is determined by the total equivalents of the phospholipid and the additional component. Many of the above-mentioned extreme pressure agents and corrosion- and oxidation-inhibitors also serve as antiwear agents.

Pour point depressants are additives often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Antifoam agents are used to reduce or prevent the formation of stable foam. Typical antifoam agents include silicones or organic polymers. Additional antifoam compositions are described in "Foam Control Agents", by Henry T. Kerner (Noyes Data Corporation, 1976), pages 125–162.

Lubricants

As previously indicated, the above described components may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in natural gas engines, stationary power engines and turbines and the like. Automatic or manual transmission fluids, transaxle lubricants, gear lubricants, both for open and enclosed systems, tractor lubricants, metal-working lubricants, hydraulic fluids and other lubricating oil and grease compositions can also benefit from the incorporation therein of the compositions of the present invention. They may also be used in lubricants for wirerope, walking cam, slideway, rock drill, chain and conveyor belt, worm gear, bearing, and rail and flange applications.

The concentrate may contain the lubricant components used in preparing fully formulated lubricants. The concentrate also contains a substantially inert organic diluent, which includes kerosene, mineral distillates, or one or more of the oils of lubricating viscosity discussed below. In one embodiment, the concentrates contain from about 0.01% up to about 90%, or from about 0.1% up to about 80%, or from about 1% up to about 70% by weight of the above described components.

In one embodiment, the lubricating composition contains less than about 2%, or less than about 1.5%, or less than about 1.0%, or less than about 0.5% by weight of reaction product of a polyisobutenyl substituted succinic anhydride and a polyalkylenepolyamine. In another embodiment, the lubricating compositions, such as gear lubricants, contain less than 2%, or less than 1.5%, or less than 1% by weight of a dispersant, such as those described herein. The dispersants may include carboxylic dispersants, amine dispersants, Mannich dispersants, post-treated dispersants and polymeric dispersants.

The lubricating compositions and methods of this invention employ an oil of lubricating viscosity, including natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalphaolefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity or a mixture of oils of lubricating viscosity are selected to provide lubricating compositions with a kinematic viscosity of at least about 3.5 cSt, or at least about 4.0 cSt at 100° C. In one embodiment, the lubricating compositions have an SAE gear viscosity number of at least about SAE 65, or from at least about SAE 75. The lubricating composition may also have a so-called multigrade rating such as SAE 75W-80, 75W-90, 75W-90, or 80W-90. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, or from polymethacrylate. Viscosity improvers available commercially include Acryloid™ viscosity improvers available from Rohm & Haas; Shellvis™ rubbers available from Shell Chemical; and Lubrizol 3174 available from The Lubrizol Corporation.

The following examples relate to lubricating composition containing the components of the present invention.

EXAMPLE I

A lubricating composition is prepared by incorporating 1.5% by weight of a Primene 81 R amine salt of a hydrocarbyl phosphate prepared by reacting phosphorus pentoxide with Alfol 8-10 alcohol mixture; 3.7% by weight of the organic polysulfide of Example S-1; and 1.2% of the product of example P-3 into an SAE 80W-90 lubricating oil mixture.

EXAMPLE II

A lubricating composition is prepared by incorporating 1.2% by weight of the phosphate of Example I, 3.2% by weight of the polysulfide of Example S-1, and 1.2% by weight of an oil solution containing 67% by weight of a borated dispersant prepared by reacting a polybutenyl ($\overline{M}n$=950) succinic anhydride with polyamine bottoms to form an intermediate which is further reacted with boric acid, wherein the oil solution contains 2.3% nitrogen and 1.9% boron into a 75W-90 lubricating oil mixture.

EXAMPLE III

A lubricating composition is prepared as described in Example I, except a.2% of the product of Example I-3 is additionally included in the lubricating oil mixture.

EXAMPLE IV

A lubricating composition is prepared as described in Example III except 0.8% by weight of the borated dispersant of Example II is additionally included in the oil mixture.

EXAMPLE V-VIII

The Table 1 contains further examples of lubricating compositions containing the components of the present invention. The lubricating compositions are prepared by incorporating the components into an SAE 80W-90 lubricating oil mixture.

TABLE 1

| | Ex. V | Ex. VI | Ex. VII | Ex. VIII |
|---|---|---|---|---|
| Phosphate of Example I | 0.9 | 2 | 1 | 3 |
| Organic polysulfide of Example S-1 | 3.2 | 3.5 | 3.5 | 3.5 |
| Product of Example I-3 | — | 1.2 | 1.1 | 0.9 |
| Product of Example P-3 | 1.2 | 1.2 | 1.2 | 1.2 |
| Borated dispersant of Example I | 0.9 | — | — | 1.2 |
| Tolyltriazole | 0.25 | 0.25 | 0.25 | 0.25 |
| Monoisopropanol amine | 0.03 | — | — | — |
| Polyacrylate foam inhibiter | 0.05 | 0.08 | 0.08 | 0.08 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for improving the limited slip character of a gear or transmission lubricant comprising the steps of (1) providing a top treatment comprising at least one amine salt of a saturated fatty phosphate, and either at least one fatty imidazoline or at least one reaction product of a fatty acid and a polyamine, (2) adding the top treatment to a composition comprising a gear or transmission oil package and a major amount of an oil of lubricating viscosity wherein the gear or transmission oil package is free of saturated fatty phosphites.

2. The process of claim 1 wherein the gear or transmission oil package is a Gl4 or GL5 gear oil package.

3. The process of claim 1 wherein the saturated fatty phosphate salt has one or more hydrocarbyl groups containing from about 4 to about 30 carbon atoms.

4. The process of claim 1 wherein the saturated phosphate fatty salt has one or more hydrocarbyl groups containing from about 5 to about 12 carbon atoms.

5. The process of claim 1 wherein the saturated phosphate fatty salt is a di- or trihydrocarbyl phosphate.

6. The process of claim 1 wherein the saturated phosphate fatty salt is a mono or dihydrocarbyl phosphate amine salt.

7. The process of claim 1 wherein the fatty imidazoline and the fatty acid have at least one group having from 8 to about 30 carbon atoms.

8. The process of claim 1 wherein the top treatment further comprises at least one borated dispersant.

9. The process of claim 8 wherein the borated dispersant is a borated reaction product of a hydrocarbyl substituted carboxylic acylating agent, a polyamine and a boron compound.

10. The process of claim 1 wherein the gear or transmission oil package contains at least one polysulfide and at least one phosphorus antiwear or extreme pressure agent.

11. The process of claim 10, wherein the polysulfide is prepared from an unsaturated compound represented by the formula $$R^{*1}R^{*2}C{=}CR^{*3}R^{*4},$$

wherein each of $R^{*1}$, $R^{*2}$, $R^{*3}$ and $R^{*4}$ is independently hydrogen, hydrocarbyl, —$C(R^{*5})_3$, —$COOR^{*5}$, —$CON(R^{*5})_2$, —$COON(R^{*5})_4$, —COOM, —CN, —X, —$YR^{*5}$ or —Ar, wherein each $R^{*5}$ is independently hydrogen or hydrocarbyl group, with the proviso that any two $R^{*5}$ groups can be hydrocarbylene or substituted hydrocarbylene whereby a ring of up to about 12 carbon atoms is formed; M is one equivalent of a metal cation; X is halogen; Y is oxygen or divalent sulfur; Ar is an aryl or substituted aryl group of up to about 12 carbon atoms.

12. The process of claim 11, wherein each $R^{*1}$, $R^{*2}$, $R^{*3}$ and $R^{*4}$ is independently hydrogen or a hydrocarbyl group.

13. The process of claim 10 wherein the polysulfide is prepared from an olefin having from 2 to about 8 carbon atoms.

14. The process of claim 10 wherein the phosphorus antiwear or extreme pressure agent is a phosphoric acid ester prepared by reacting a dithiophosphoric acid with an epoxide to form an intermediate, and the intermediate is further reacted with a phosphorus acid or anhydride.

15. The process of claim 14 wherein the phosphoric acid ester is further reacted with ammonia or an amine.

16. The process of claim 14 wherein the phosphoric acid ester is prepared by reacting a phosphorus acid or anhydride with at least one alcohol containing from one to about 30 carbon atoms, or salt thereof.

17. The process of claim 10 wherein the phosphorus antiwear or extreme pressure agent is a lower hyrocarbyl phosphite independently having from one to about six carbon atoms in each hydrocarbyl group.

18. The process of claim 10 wherein the phosphorus antiwear or extreme pressure agent is a phosphorus-containing carboxylic amide, acid, ester, or ether prepared by reaching a phosphorus acid with an unsaturated compound.

19. The process of claim 18 wherein the phosphorus acid is a dithiophosphoric acid.

20. The process of claim 19 wherein the unsaturated compound is an unsaturated amide selected from the group consisting of acrylamide, N, N'-methylene bisacrylamide, methacrylamide, and crotonamide.

21. The process of claim 18 wherein the unsaturated compound is an unsaturated acid or ester represented by one of the formulae: $R_{13}C{=}C(R_{14})C(O)OR_{15}$, or $R_{15}O{-}(O)C{-}HC{=}CH{-}C(O)OR_{15}$, wherein each $R_{13}$ and $R_{15}$ are independently hydrogen or a hydrocarbyl group having 1 to about 18, $R_{14}$ is hydrogen or an alkyl group having from 1 to about 6 carbon atoms.

22. The process of claim 18 wherein the unsaturated compound is an unsaturated ester selected from the group consisting of a methyl-, ethyl-, butyl-, hexyl-, or 2-ethylhexyl-acrylate, -methacrylate, or -maleate.

23. The process of claim 18 wherein the unsaturated compound is a vinyl ether represented by the formula $R_{16}{-}CH_2{=}CH{-}OR_{17}$ wherein $R_{16}$ is hydrogen or a hydrocarbyl group having from 1 up to about 30 carbon atoms, and $R_{17}$ is a hydrocarbyl group having from 1 up to about 30 carbon atoms.

24. The process of claim 18 wherein the unsaturated compound is a vinyl ester represented by the formula $R_{18}CH{=}CH{-}O(O)CR_{19}$, wherein $R_{18}$ is hydrogen or a hydrocarbyl group having from 1 to about 30 carbon atoms, and $R_{19}$ is a hydrocarbyl group having 1 to about 30 carbon atoms.

25. The process of claim 10 wherein the gear or transmission oil package further comprises at least one borated overbased sulfonate, carboxylic, or phenate.

* * * * *